US011998042B2

(12) United States Patent
Hagen

(10) Patent No.: US 11,998,042 B2
(45) Date of Patent: Jun. 4, 2024

(54) WATER PIPE WITH ACCURATE FIT FOR A CAPSULE

(71) Applicant: AIR IP HOLDINGS LIMITED, Dubai (AE)

(72) Inventor: Klaus Hagen, Haren (DE)

(73) Assignee: AIR IP HOLDINGS LIMITED, Dubai (AE)

( * ) Notice: Subject to any disclaimer, the term of this patent is extended or adjusted under 35 U.S.C. 154(b) by 577 days.

(21) Appl. No.: 17/252,514

(22) PCT Filed: Jun. 15, 2018

(86) PCT No.: PCT/DE2018/100566

§ 371 (c)(1),
(2) Date: Dec. 15, 2020

(87) PCT Pub. No.: WO2019/238150

PCT Pub. Date: Dec. 19, 2019

(65) Prior Publication Data

US 2021/0267272 A1 Sep. 2, 2021

(51) Int. Cl.

| | |
|---|---|
| ***A24F 1/30*** | (2006.01) |
| ***A24F 40/42*** | (2020.01) |
| ***A24F 40/46*** | (2020.01) |

(52) U.S. Cl.

CPC ..... *A24F 1/30* (2013.01); *A24F 40/42* (2020.01); *A24F 40/46* (2020.01)

(58) Field of Classification Search

None

See application file for complete search history.

(56) References Cited

U.S. PATENT DOCUMENTS

| | | | | |
|---|---|---|---|---|
| 3,402,723 | A | 9/1968 | Yow-Jiun | |
| 3,918,464 | A | 11/1975 | Kolodziej | |
| 4,031,906 | A | 6/1977 | Knapp | |
| 4,133,318 | A | 1/1979 | Gross | |
| 4,788,988 | A | 12/1988 | Titus | |
| 7,287,530 | B1 | 10/2007 | Stuart | |
| 7,775,218 | B2 | 8/2010 | Shraiber | |
| 8,347,892 | B2 | 1/2013 | Mehio | |
| 8,464,725 | B2 | 6/2013 | Badawi | |
| 8,550,901 | B2 | 10/2013 | Walker | |
| 10,820,626 | B2 * | 11/2020 | Benjamignan | H01M 10/425 |
| 2004/0069446 | A1 | 4/2004 | Horiuchi et al. | |
| 2005/0279371 | A1 | 12/2005 | Billard et al. | |
| 2006/0086364 | A1 | 4/2006 | Liu et al. | |
| 2006/0086365 | A1 | 4/2006 | Liu et al. | |
| 2007/0056599 | A1 | 3/2007 | Zoumut et al. | |
| 2008/0060663 | A1 | 3/2008 | Hamade et al. | |

(Continued)

FOREIGN PATENT DOCUMENTS

| | | | |
|---|---|---|---|
| CN | 202276825 | U | 6/2012 |
| CN | 104055225 | A | 9/2014 |

(Continued)

*Primary Examiner* — James Harvey

(74) *Attorney, Agent, or Firm* — Hayes Soloway PC

(57) ABSTRACT

A water pipe (1) comprises a receptacle (3) and a heating chamber (4) communicating therewith, said heating chamber (4) having a receiving portion (5) for a capsule (10) which holds a smoking medium, said receiving portion at the same time being a heating element for the capsule (10). The receiving portion (5) accurately fits the capsule (10).

17 Claims, 9 Drawing Sheets

(56) References Cited

U.S. PATENT DOCUMENTS

| | | | |
|---|---|---|---|
| 2009/0084391 | A1 | 4/2009 | Krupp et al. |
| 2009/0151717 | A1 | 6/2009 | Bowen et al. |
| 2010/0025057 | A1 | 2/2010 | Andersson et al. |
| 2010/0126516 | A1 | 5/2010 | Yomtov et al. |
| 2010/0186091 | A1 | 7/2010 | Turner et al. |
| 2010/0212679 | A1 | 8/2010 | Bishara et al. |
| 2010/0263681 | A1 | 10/2010 | Zhao et al. |
| 2011/0180080 | A1 | 7/2011 | Fares et al. |
| 2011/0186059 | A1 | 8/2011 | Mouhanna et al. |
| 2011/0186060 | A1 | 8/2011 | Saleh et al. |
| 2012/0042884 | A1 | 2/2012 | Mukaddam |
| 2012/0067357 | A1 | 3/2012 | Boutros et al. |
| 2012/0199572 | A1 | 8/2012 | Shen et al. |
| 2013/0199547 | A1 | 8/2013 | Popmarkov et al. |
| 2014/0060554 | A1 | 3/2014 | Collett et al. |
| 2014/0069446 | A1 | 3/2014 | Haddad et al. |
| 2014/0230832 | A1 | 8/2014 | Saliman et al. |
| 2015/0053221 | A1 | 2/2015 | Asghar-Sheikh et al. |
| 2016/0206001 | A1 | 7/2016 | Eng et al. |
| 2016/0235122 | A1 | 8/2016 | Krietzman et al. |
| 2017/0099873 | A1 | 4/2017 | Benjamignan |
| 2017/0172203 | A1 | 6/2017 | Gebara |
| 2017/0251718 | A1 | 9/2017 | Armoush et al. |
| 2018/0199624 | A1 | 7/2018 | Ammar et al. |
| 2018/0271150 | A1 | 9/2018 | Sparklin et al. |
| 2018/0317544 | A1* | 11/2018 | Hagen ..... A24F 1/30 |
| 2021/0186090 | A1 | 6/2021 | Hagen et al. |
| 2021/0186091 | A1 | 6/2021 | Hagen |
| 2021/0267272 | A1* | 9/2021 | Hagen ..... A24F 1/30 |
| 2021/0307385 | A1* | 10/2021 | Franzone ..... A61M 15/0028 |

FOREIGN PATENT DOCUMENTS

| | | | |
|---|---|---|---|
| CN | 104522890 | B | 4/2015 |
| CN | 103653244 | A | 2/2017 |
| CN | 112930122 | A | 6/2021 |
| CN | 112930123 | A | 6/2021 |
| DE | 498312 | C | 5/1930 |
| DE | 202005015795 | U1 | 12/2005 |
| DE | 202008010123 | U1 | 4/2009 |
| DE | 102014005884 | A1 | 10/2015 |
| DE | 102015121435 | A1 | 5/2017 |
| EP | 2179967 | B1 | 4/2010 |
| EP | 2292108 | A1 | 3/2011 |
| EP | 2422633 | A1 | 2/2012 |
| FR | 3019989 | B1 | 10/2015 |
| GB | 2553773 | A | 3/2018 |
| WO | 2013001272 | A1 | 1/2013 |
| WO | 2013057185 | A1 | 4/2013 |
| WO | 2014012216 | A1 | 1/2014 |
| WO | 2015097424 | A1 | 7/2015 |
| WO | 2015172224 | A1 | 11/2015 |
| WO | 2017080545 | A1 | 5/2017 |

* cited by examiner

WATER PIPE WITH ACCURATE FIT FOR A CAPSULE

CROSS-REFERENCE TO RELATED APPLICATIONS AND PRIORITY

This patent application claims priority from PCT Patent Application No. PCT/DE2018/100566 filed Jun. 15, 2018. This patent application is herein incorporated by reference in its entirety.

TECHNICAL FIELD

The invention relates to a water pipe with a housing, into which a receptacle that is to be filled with a liquid medium and is provided with at least one suction connection, and a heating chamber communicating therewith, are integrated, said heating chamber having a receiving portion for a capsule which holds a smoking medium, said receiving portion at the same time being a heating element for the capsule.

Water pipes of this type, which originate in the Middle East, are also known as shishas or hookahs and have enjoyed increasing popularity among young people and adolescents in recent years, not least as an alternative to cigarettes. Such water pipes are known, for instance, from U.S. Pat. No. 4,031,906 or US 2012/0042884. A water pipe of this type has a receptacle that is partially filled with water or another liquid medium. Sucking on a mouthpiece causes a negative pressure in this receptacle. Furthermore, a smoke column projects a certain distance into the water, this column having at its top end a head piece for receiving tobacco, which is heated by charcoal that is placed on top. The mixture of air, vapour and smoke particles that is produced when the tobacco is heated is then inhaled by the smoker. It is evident that the use of hot charcoal for heating could lead to carbon monoxide poisoning, burns, or in extreme cases the breakout of a fire. Furthermore, owing to the water pipe being filled manually, it cannot be guaranteed that it will be set up in a legally compliant manner. In principle, water pipes that are nowadays known as shishas should therefore only be operated outdoors or in rooms with a guaranteed supply of fresh air. Shishas according to the prior art are also extremely heavy and voluminous once constructed, but also have to be assembled from several parts, and transporting them in their individual parts is cumbersome. Cleaning these pipes is also a laborious process and frequently does not meet hygiene standards. U.S. Pat. No. 4,133,318 discloses electronic shishas, with which some of the above-mentioned problems can be reduced, albeit not to a satisfactory degree. The shishas known from WO 2017/080545 have proved to be particularly advantageous.

However, there are still deficits in the prior art with regard to the sensitive topic of effective heat transfer between the heating chamber and the capsule with the smoke medium that is inserted therein.

Therefore, the object of the present invention is to provide a water pipe that is also known as a shisha or hookah, which is characterised by a particularly effective and targeted transfer of heat between the heating chamber of the water pipe and the capsule inserted therein.

This object is achieved according to the invention by means of an accurate fit between the receiving portion and the capsule.

It is important to guarantee high effectiveness of the heat transfer between the heating chamber and the capsule that is inserted therein and is filled with a liquid or solid medium, which is achieved by means of an accurate fit between the receiving portion or parts of this receiving portion on the one hand, and the capsule on the other hand. Ideal heat transfer from the heating chamber into the capsule is essential in order to achieve an optimum smoking process. This is achieved through precise thermal and geometrical fixation and/or coordination of the three components—the heating chamber, receiving portion and capsule.

The cone on the receiving portion side or the capsule side is also highly important with regard to the accurate fit. This cone permits a particularly targeted heat transfer by means of an accurate fit between the receiving portion wall that surrounds the sides of the capsule, and the capsule itself. The more firmly the capsule sits in the receiving portion, the more effectively the heat travels from the outside, i.e. from the heating chamber to the capsule. A small amount of play may be permitted here, but this must not lead to the capsule rattling around in the receiving portion. The receiving portion therefore serves to ensure that the capsule can be inserted into the shisha, or more precisely into the heating chamber, with the receiving portion also serving as a heating element for the capsule, in which the wall that surrounds the capsule has particular significance.

In a particularly advantageous variant of an accurate fit of this type, the lateral wall of the receiving portion tapers conically in the direction of the interior of the heating chamber, the cone having an angle of approx. 5°-10°, preferably approx. 7°. A type of clamped fitting of the capsule in the receiving portion is achieved if both the receiving portion and the capsule have a tapering of this sort. After a small recess of constant diameter, which runs parallel to the longitudinal axis of the receiving portion or the capsule, respectively, on the side facing away from the interior of the receiving portion, the much larger, tapering section of the receiving portion or the capsule, respectively, follows.

An ideal geometry is achieved when the diameter of the receiving portion between the front and rear of the receiving portion or the capsule, respectively, increases constantly by a factor of approximately 1.1 to 1.25, preferably approx. 1.17.

According to one embodiment of the invention, the receiving portion has on its inner side a front wall having an opening, which front wall extends essentially transverse to the longitudinal axis of the housing. This front wall forms the termination of the receiving portion in the direction of the interior of the heating chamber.

In the other direction of the receiving portion, it is expedient for the receiving portion to have on its outer side a cover ring which extends transverse to the longitudinal axis of the housing, in which cover ring the receiving portion for the capsule is integrated. In other words the cover ring and the heating chamber, respectively, are arranged and formed in relation to one another such that the cover ring has a central opening in which the capsule sits in the receiving portion. At the same time, depending on the arrangement of the receptacle, heating chamber, etc., the cover ring forms the top or bottom termination of the housing or the heating chamber.

Furthermore, the cover ring has the function of serving as an end stop for a collar on the capsule side when the capsule is inserted into the heating chamber. The cover ring thus guarantees the fit of the capsule in the heating chamber, not least by means of the fact that the capsule has a collar with which it abuts against the cover ring.

Another constructive measure according to the invention is for the cover ring to be connected to a collar provided on the outer side of the receiving portion, or to be formed integrally with said collar. This collar on the receiving portion provides the fixed connection between the receiving portion and the cover ring as an additional element for the integration of the receiving portion for the capsule in the cover ring.

The importance according to the invention of the firm fit of the capsule in the receiving portion for the targeted transfer of heat to the capsule has already been mentioned several times. The capsule must now of course also be held at its back face having the collar so that it does not slip out of the receiving portion. On this basis it is proposed that the heating chamber be closable by means of a base plate or cover plate, the plate having on its inner face fittings that act on the capsule that is to be inserted or has been inserted. The air inlet is integrated in the chamber, either in the plate or the wall of the receiving portion. When the plate is closed, and thus also the heating chamber, the capsule according to the invention finds its functional position itself, i.e. the end position of an inserted, latched, bolted etc. plate corresponds to the capsule in its functional position in which smoking can begin. With the plate removed, the capsule is thus inserted from above or below, depending on the design of the shisha, into the heating chamber, so that the capsule is completely received by the housing of the shisha. The used cartridge can then be removed from the chamber and replaced with a new one filled with medium.

These functions are supplemented by the fittings on the inner face of the plate, which inner face faces the receiving portion.

According to one proposal for such fittings, the plate has on its inner face an annular bead which is arranged and/or designed correspondingly to the collar of the capsule. Consequently, this annular bead has a smaller diameter than the cover ring, the annular bead lying exactly opposite the collar of the capsule so that the annular bead automatically presses the capsule into the receiving portion when the lid is closed.

As an additional retaining measure, the fittings are equipped with latching means. Specifically, this means that the annular bead has latching means that wedge into the capsule receiving portion and can thus guarantee an additionally stable fit of the capsule in the receiving portion and thus in the heating chamber.

It is intended, for instance, for the latching means to be arranged adjustably in the radial direction and, in this manner, to wedge in the capsule receiving portion in the extended position.

According to another advantageous embodiment of the invention, the plate comprises in its outer face a handle for actuation of the plate, by means of which the plate can thus be offset e.g. in rotations when assembling and dismantling the plate.

Thanks to a mechanism for pushing the used capsule out of its seat in the receiving portion counter to the direction of insertion, used capsules can be pressed out of their seat in the receiving portion on the heating chamber side without the user needing to come into contact with parts of the water pipe that may have been exposed to high temperatures. Such health hazards owing to the high temperatures of up to 200° C. that heated shisha capsules can reach are therefore ruled out, as is jamming of the capsule when removing it. Furthermore, any expansion processes of the capsule are irrelevant, since the capsule can be pressed out of the receiving portion in a particularly effective manner from the receptacle direction. The fact that the mechanism can be operated from outside the heating chamber has the same aim, specifically achieving sufficient distance between the hand of the user and the heating chamber or the capsule therein.

In an advantageous embodiment of the invention, the suction pipe is movably arranged in the direction of its longitudinal axis. This is a particularly optimal solution for such a mechanism, since the suction pipe which would always be present anyway is given the additional function of serving as a mechanism for releasing the capsule. Furthermore, this is done in connection with a completely safe removal with regard to the high temperature of the used capsule in the heating chamber. A simple press on the suction pipe exerts a force on the capsule counter to the direction in which it was inserted. Consequently, the capsule is loosened from its seat in the receiving portion on the heating chamber side. For improved handling, it is intended for the suction pipe to be movably arranged counter to the force of a spring so that the suction pipe returns to its starting position after it has been used to release the capsule and the play of the suction pipe during operation is limited.

It is furthermore intended for the receptacle and a housing part having an electronic unit to be detachably connected to each other, and for a valve to be provided in the region of the mouth of the suction pipe in the receptacle. The housing of the water pipe consists essentially of the receptacle as the first housing part, the second housing part holding the electronics and the suction pipe, and the third housing part holding the heating chamber for the capsule, expediently in the stated order from top to bottom. The receptacle and the housing part holding the electronic unit are detachably connected to each other and also by way of a valve ensuring additional sealing, securing the shisha according to the invention against the escape of additional air in a particularly effective manner. Preferably, the valve is arranged centrally and, optionally, a part thereof projects into the interior of the receptacle. The valve has a precise fit on the suction pipe projecting upwards out of the housing part. The suction pipe, which opens into the heating chamber with its bottom end and passes through the housing part, has at its top end a precise fit with the valve so that no additional air can escape from anywhere in this entire region. Specifically, the suction pipe opens into the base of the receptacle from below, the base generally being designed sufficiently solidly as to form a stable bearing for the valve and the end of the pipe. According to an expedient embodiment of the invention, the base of the receptacle has a cavity with an integrated central mounting plate for fixing the suction pipe. Therefore, the centrally positioned mounting plate in the cavity of the otherwise comparatively solid base serves as a bearing for the suction pipe.

The invention is characterised in particular by the creation of a water pipe (or shisha or hookah) that is characterised by particular compactness, safety, user-friendliness, easy cleaning and a wide variety of possible variations. The user first draws air through an inlet on the top or bottom of the housing into a heating chamber in which tobacco-containing or non-tobacco-containing, liquid or solid smoking medium is located, expediently in a capsule that is to be inserted into the heating chamber in the manner of an oven. As a result, the capsule is situated to some extent in the air current that the user generates at the top end of the housing by means of suction, i.e. by creating a negative pressure. At the same time, the solid or liquid smoking medium in the capsule is heated by means of a heating mechanism. From the capsule inserted into the heating chamber, the mixture of air and smoking medium then travels through a suction pipe into the upper receptacle, also called a water tank, where it passes through the water and can then be inhaled via a suction device. The accurate fit between the receiving portion and the capsule, specifically between the chamber wall that surrounds the sides of the capsule and the capsule itself, facilitates an ideal heat transfer from the heating chamber to the capsule, and thus ideal smoke development. A type of advantageous clamping effect is achieved in that the lateral cone of the receiving portion and the lateral cone of the capsule correspond to each other. Alternatively, or in addition, it is conceivable to use an adjusting member which, in its working position, exerts a clamping force on the capsule and therefore holds it in position.

Further details and advantages of the subject matter of the invention arise from the following description of the associated drawing, in which a preferred exemplary embodiment is shown along with the necessary details and individual parts.

DETAILED DESCRIPTION OF THE DRAWINGS

Figure 1:
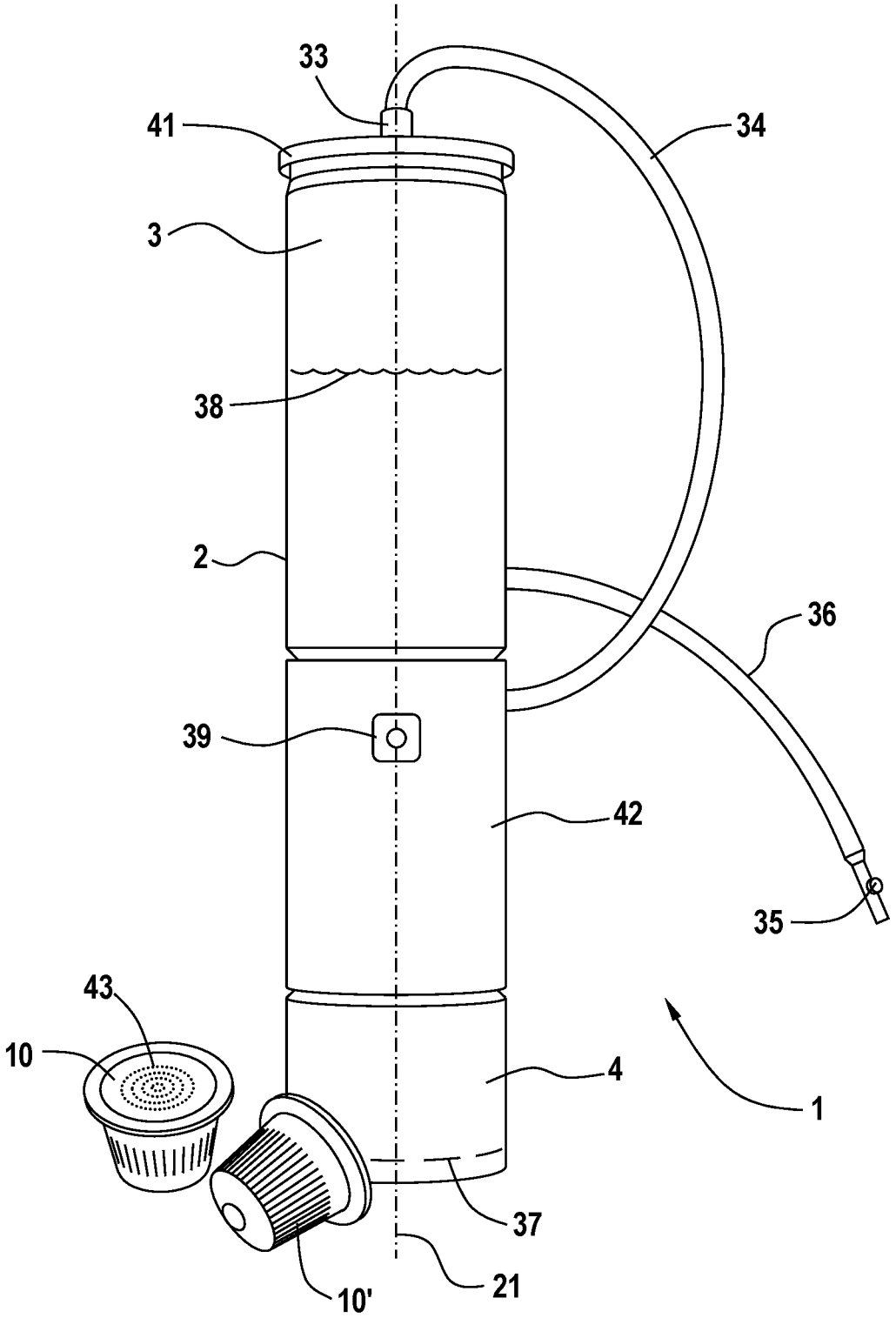
FIG. 1 shows a side view of a water pipe.

FIG. 1 shows a water pipe 1, also called a shisha or hookah, with its housing 2. The receptacle 3 is closed to the top by means of the cover 41. A suction hose 34 is connected with its integral end to the connecting piece 33 as a part of the cover 41, and is provided at its other end with an exchangeable mouthpiece 35. It is possible to connect multiple hoses 34, 36. The water level for the water provided in the receptacle 3 is designated by 38, especially since only partial filling of the receptacle 3 is expedient. A heating chamber and battery as well as control unit are concealed by a casing 42. The on/off/standby switch for operating the shisha is designated by 39. 10, 10' are two capsules containing smoking medium, the capsules having perforations 43. The air inlet in the form of a plurality of air slits is designated by 37.

Figure 2:
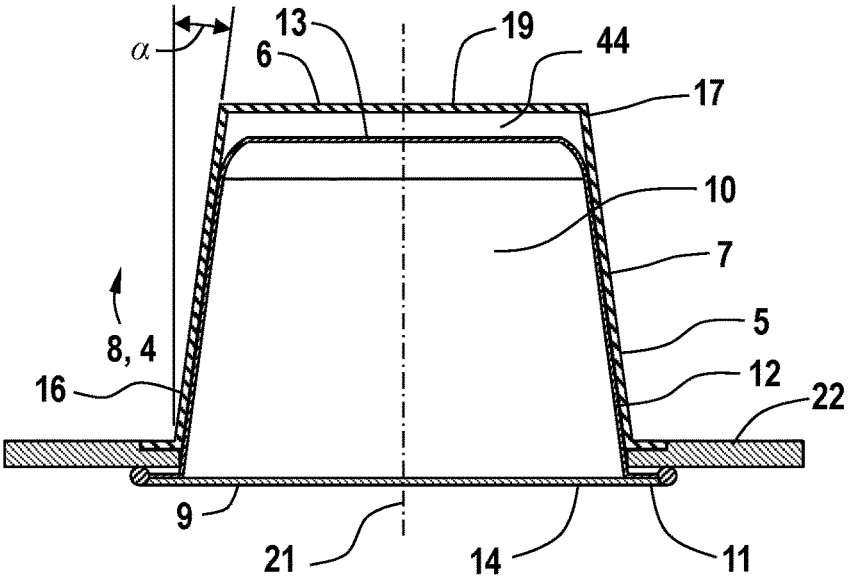
FIG. 2 shows an inserted capsule in a partial sectional view.

FIG. 2 shows a receiving portion 5 for a capsule 10. The accurate fit between the lateral wall 7 of the receiving portion 5 (outside) and the wall 12 of the capsule 10 (inside) can be seen clearly here. The two walls 7, 12 extend in the direction of the interior 8 of the heating chamber 4 in the form of a cone 15, i.e. at an angle $\alpha$ of preferably approx. 7°. The receiving portion 5 comprises on its inner side 16 a front wall 19 which has an opening and extends essentially transverse to the longitudinal axis of the housing and therefore also the receiving portion 5. A clearance 44 may remain between the front wall 19 of the receiving portion 5 and the front wall 13 of the capsule. An ideal geometry is achieved when the diameter of the receiving portion 5 between—as viewed in the direction of flow—the front 6 and rear 9 of the receiving portion 5 or the capsule, respectively, increases constantly by a factor of approximately 1.1 to 1.25, preferably approx. 1.17, here from approximately 31 mm to approximately 36 mm. The collar 11, which in turn runs transverse to the longitudinal axis 21 on the outer side 14 of the receiving portion 5, is also clearly discernible here. The receiving portion 5 for the capsule is integrated in the cover ring 22 on its outer side 17.

Figure 3:
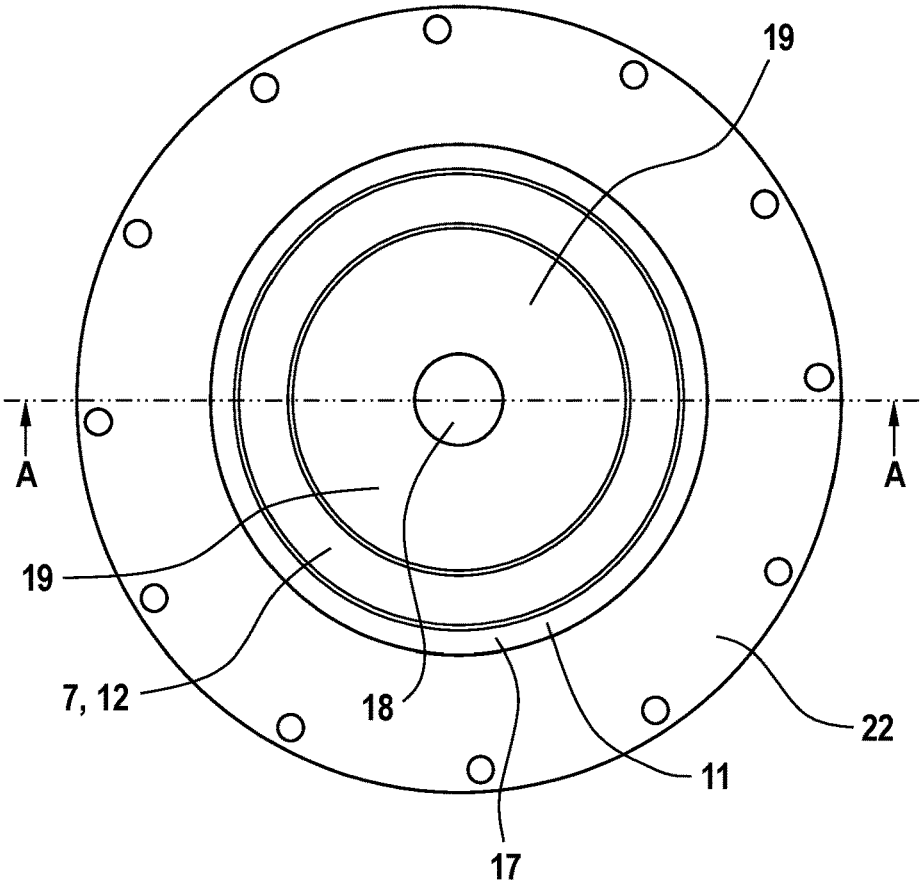
FIG. 3 shows a cover ring and receiving portion.

FIG. 3 shows, in reference to FIG. 2, the section A-A from the latter, and on the other hand, from outside to inside, the components connecting ring 22, collar 11, wall 12 in the form of the cone 7, front wall 19 and opening 18.

Figure 4:
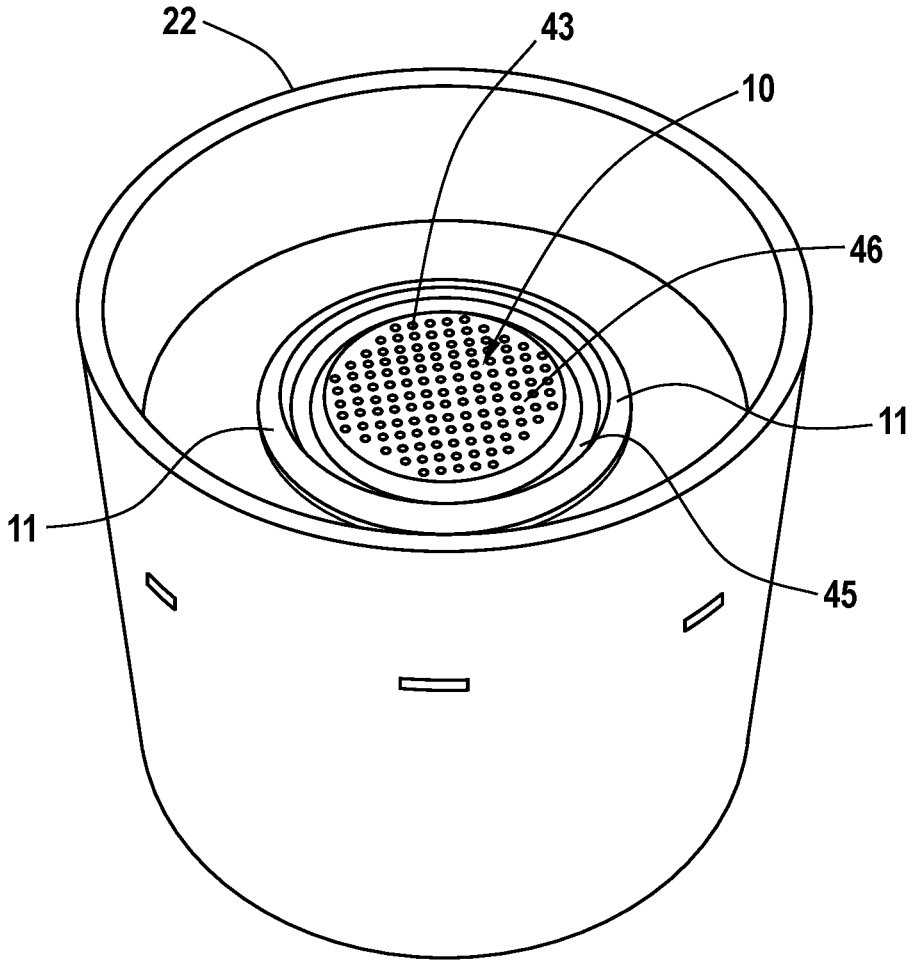
FIG. 4 shows a heating chamber from the outside with capsule inserted.

In addition, FIG. 4 shows a perspective view of the housing part with the heating chamber and inserted capsule 10 in the cover ring 22. The capsule 10 comprises a collar 11, which first passes into a groove 45 and then into the plate 46 with the perforations 43.

Figure 5:
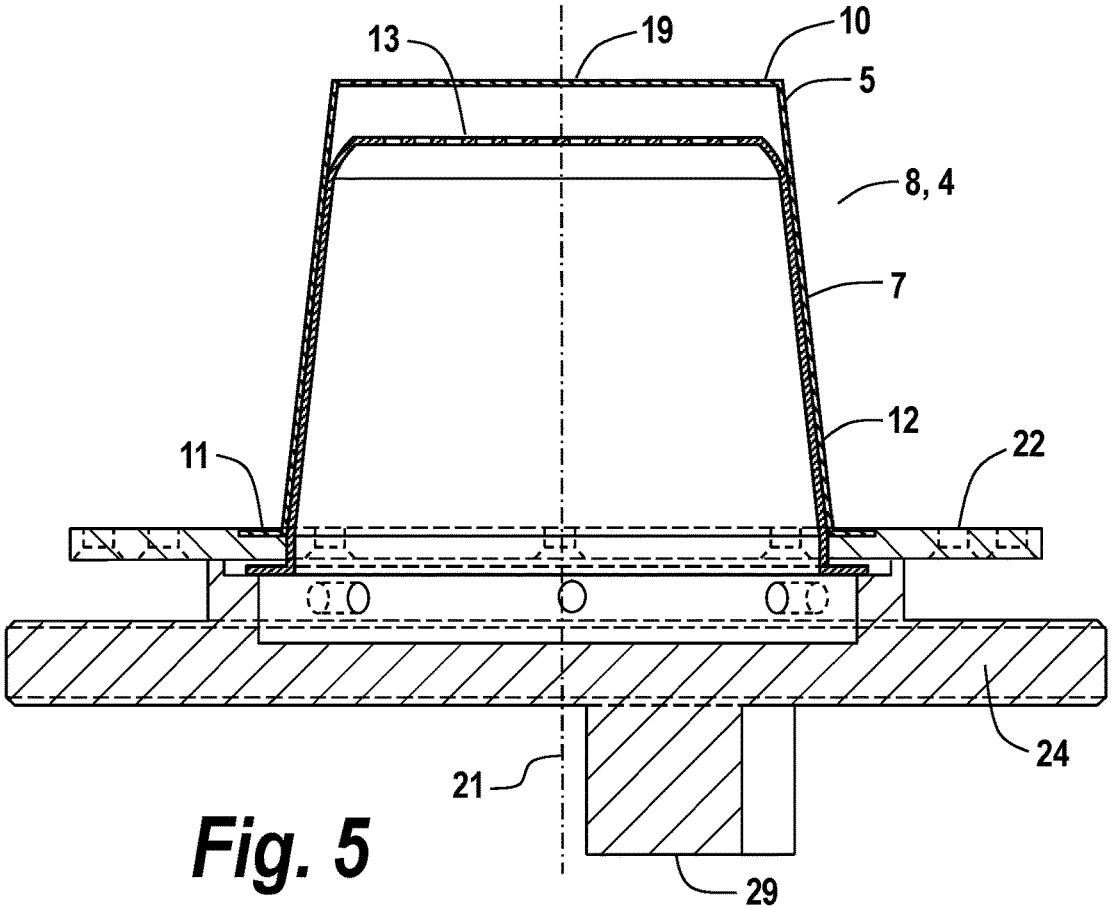
FIG. 5 shows a sectional view of receiving portion, capsule and plate.

Of particular importance in the representation according to FIG. 5 is the important interaction between the heating chamber 4, receiving portion 5, wall 7, wall 12 and cover plate or base plate 24. The heating chamber 4 is closed by means of the base plate 24, the capsule 10 adopting its functional position at the latest upon fixing, twisting or inserting the base plate 24 in the heating chamber 4. The handle 29 is used to actuate the plate 24, here by means of turning.

Figure 6:
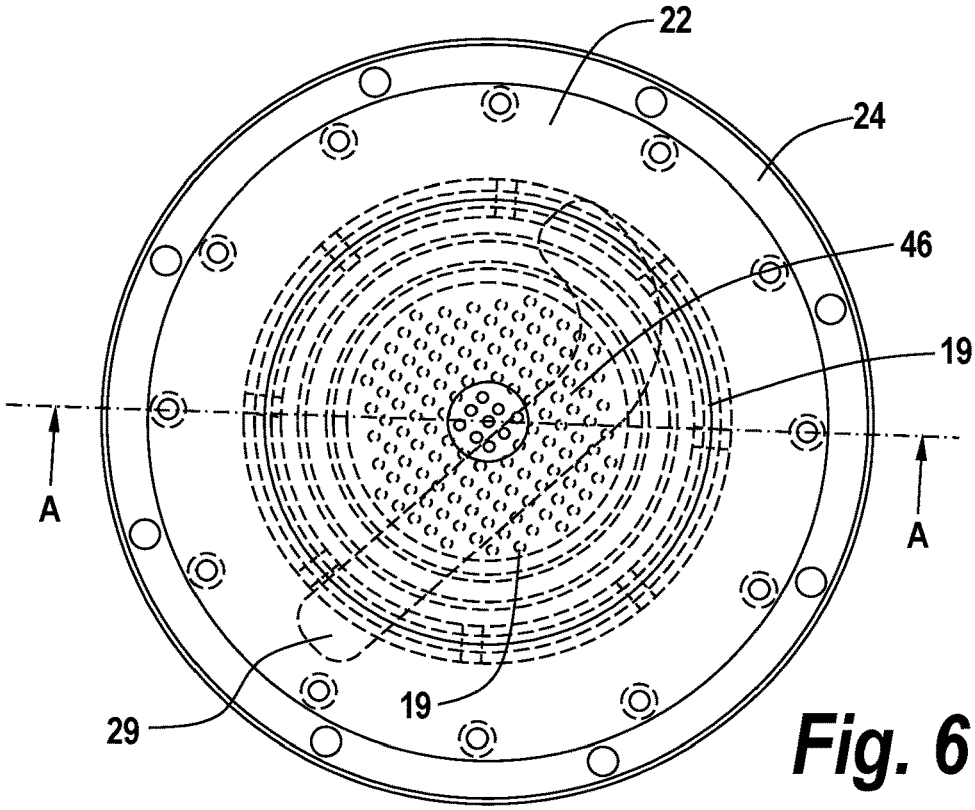
FIG. 6 shows the plan view of FIG. 5.

This handle is also given the designation 29 in FIG. 6. In turn, A-A designates the section that is then shown in FIG. 5.

Figure 7:
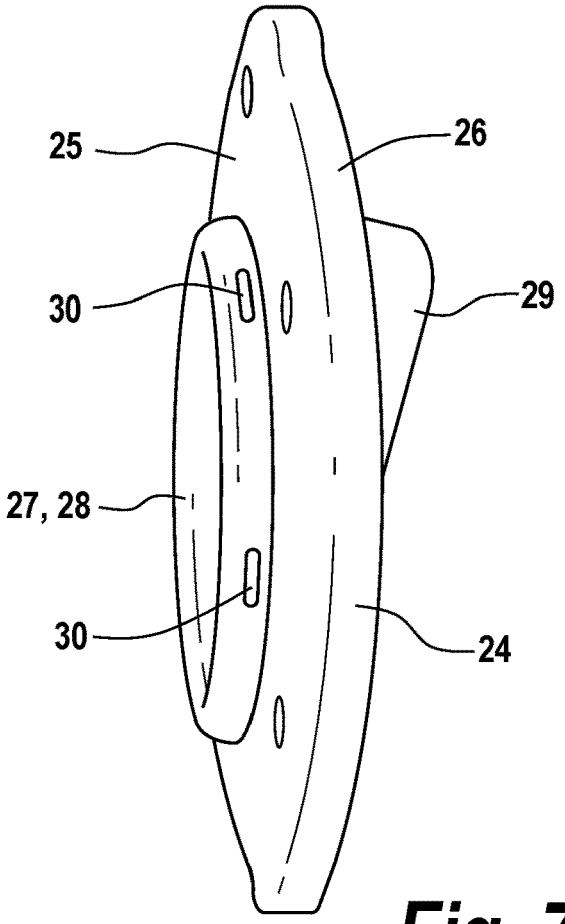
FIG. 7 shows a perspective view of a plate.

According to FIG. 7, which shows a plate 24, the latter comprises on its inner face 25 fittings 27 in the form of an annular bead 28 and on its outer face 26 the handle 29. Latching means are designated by 30 and serve to additionally wedge the cover 24 into the receiving portion (not shown here).

Figure 8:
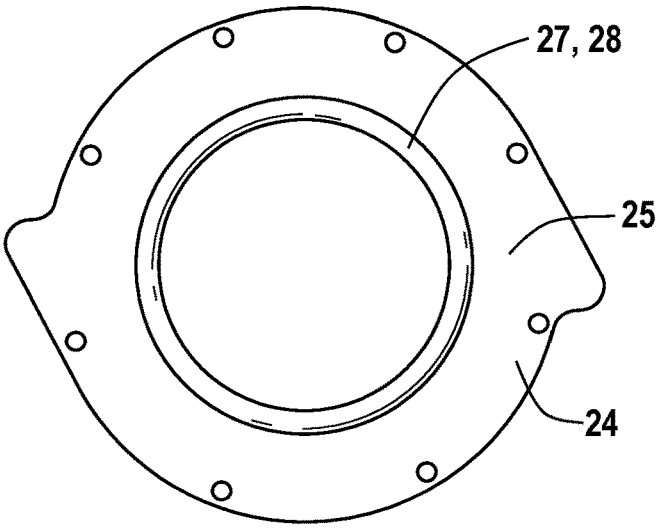
FIG. 8 shows a plan view of a plate.

FIG. 8 shows a view of the inner face 25 of the cover 24 with the fittings 27 in the form of the annular bead 28, which corresponds to the collar of the capsule (not shown here).

Figure 9:
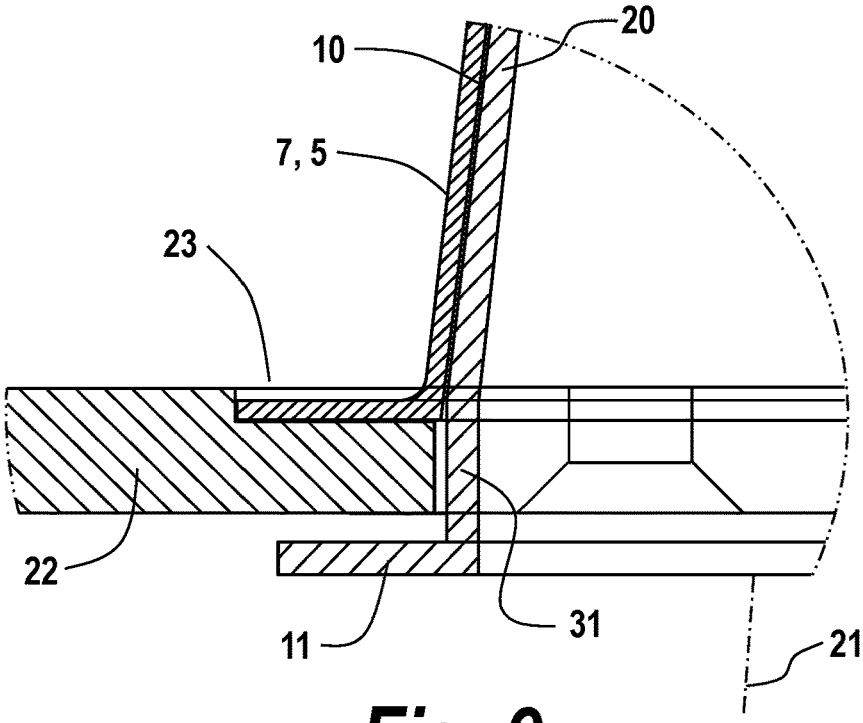
FIG. 9 shows a detail from FIG. 10.
Figure 10:
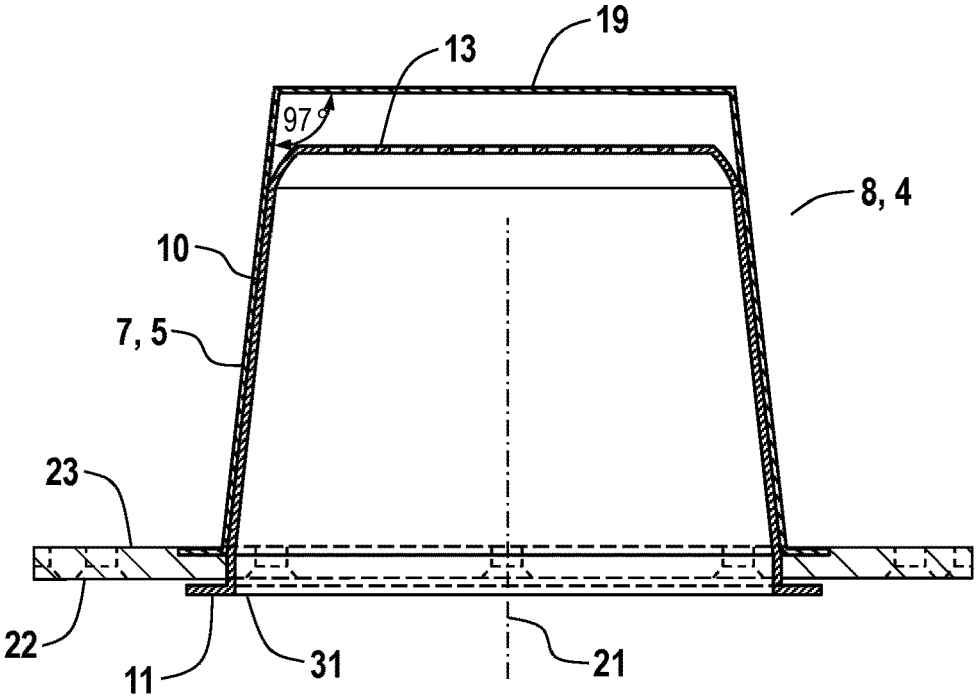
FIG. 10 shows a connecting ring, receiving portion and capsule.

FIG. 9 shows the detail circled in FIG. 10 in the form of the integration of the receiving portion in the cover ring 22. The cover ring 22 is connected to the collar 23 on the receiving portion side. At the same time, the capsule 10 with its collar 11 sits in the receiving portion 5 especially tightly thanks to the uniform cones of approx. 7°. It must also be mentioned that, for the purpose of adapting to the cover ring 22, the capsule 10 has between the collar 11 and its own wall 20 a section 31 in which the wall 20 of the capsule 10 runs exactly parallel to the longitudinal axis 21.

Figure 11:
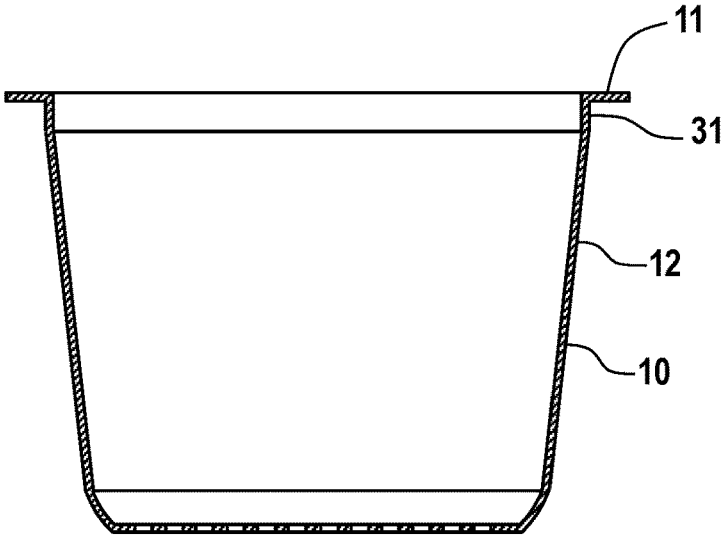
FIG. 11 shows a sectional view through the receiving portion.
Figure 12:
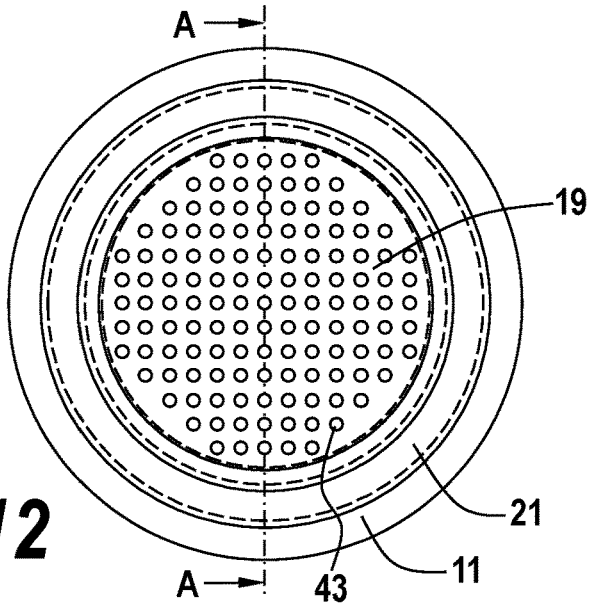
FIG. 12 shows a plan view of the receiving portion.

FIG. 11 once illustrates the section 31, which has already been discussed, in the capsule 10 between the collar 11 and wall 12. The same applies to FIG. 12.

Figure 13:
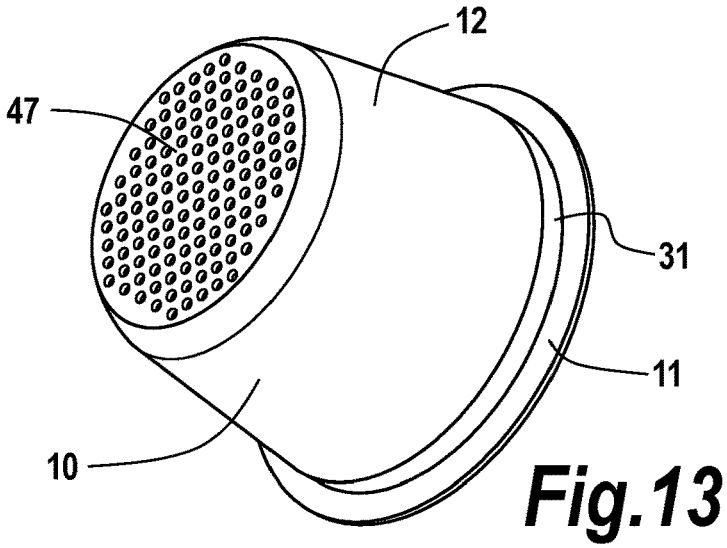
FIG. 13 shows a capsule.

Accordingly, FIG. 13 shows a capsule 10 with the conical wall 12 between the collar 11 and outlet 47.

Figure 14:
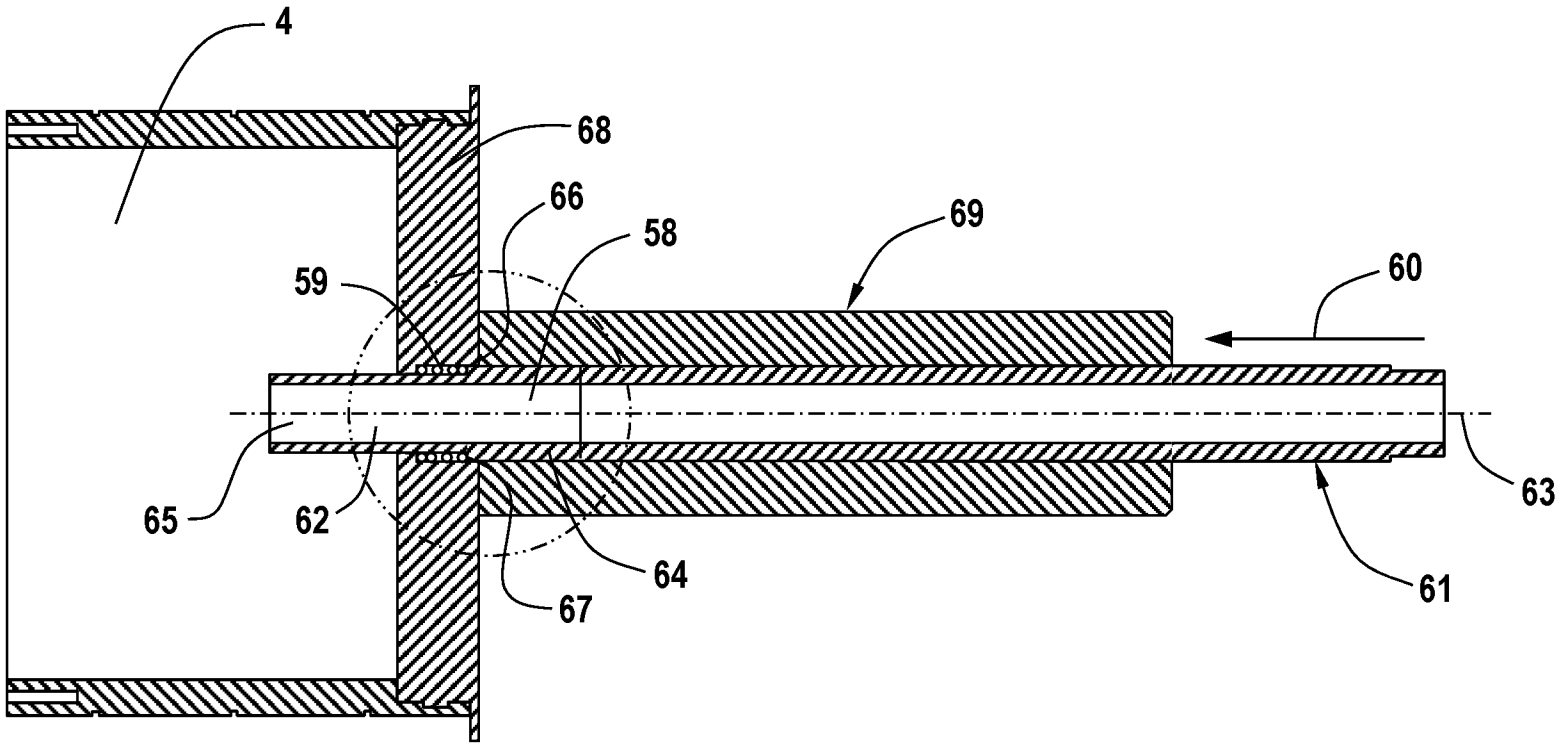
FIG. 14 shows a spring-mounted suction pipe.

FIG. 14 shows a sectional view. The reference symbol 61 is used to denote the suction pipe that is movable in the direction of the longitudinal axis 63, where pressure is to be exerted manually or via a controller in the arrow direction 60 onto the suction pipe 61. The suction pipe 61 has two pipe sections 62, 64 with different diameters. The inner section 62 of the suction pipe 61, which faces the heating chamber 4, has a smaller diameter than the outer section 64, which faces the receptacle (not shown here), so that when the suction pipe 61 is pushed, a collar 67 or stop that acts on the spring 66 is formed. It is also conceivable to provide an inner pipe 58 which has corresponding sections 62, 64. Otherwise, the inner pipe section 62 is surrounded by the compression spring 66, or the spring shaft 59 is integrated in the receptacle-facing wall 68 of the heating chamber 4. The inner pipe section 62 projecting with its front end 65 into the heating chamber 4 can be clearly seen here. A guide bolt for the suction pipe 61 is designated by 69.

Figure 15:
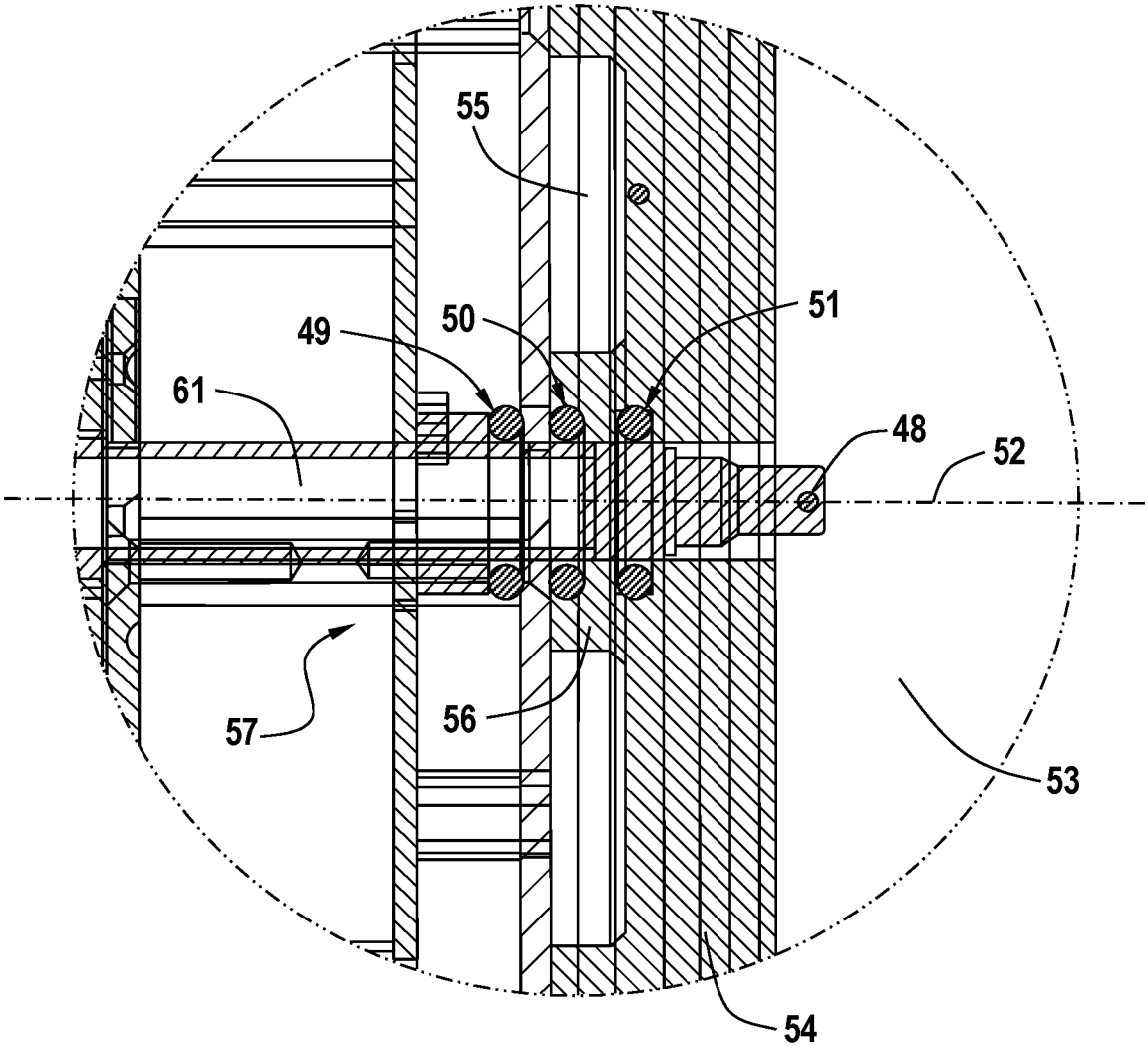
FIG. 15 shows a sectional view through the mouth of the suction pipe.

Furthermore, FIG. 15 shows a section through the water pipe 1. In the centre is the housing part, and underneath is the heating chamber 4 with the receiving portion 5 for a capsule 10 and the removable base plate 24. A threaded connection ensures that when these two components are put together, the centrally positioned valve 48 is positioned automatically, with this valve sitting in the base 54 of the receptacle or projecting a certain distance into the receptacle interior 53. FIG. 15 illustrates the solid, multi-layer design of the base 54 of the receptacle 3. The mouth 57 of the suction pipe 61 is secured by means of three seals in the form of O-rings 49, 50, 51. The valve 48 and suction pipe 61 lie in a common longitudinal axis 52. A cavity integrated into the base 54 is designated by 55 and serves to receive the central mounting plate 56 into which the suction pipe 61 then specifically opens.

The invention claimed is:

1. A water pipe with a housing, into which a receptacle that is to be filled with a liquid medium and is provided with at least one suction connection, and a heating chamber communicating therewith, are integrated, said heating chamber having a receiving portion for a capsule which holds a smoking medium, said receiving portion at the same time being a heating element for the capsule, characterized by an accurate fit between the receiving portion and the capsule whereby the receiving portion tightly surrounds the capsule, wherein the capsule comprises a collar plate with perforations and an annular groove, and wherein the heating chamber is closable by a cover plate, the cover plate having on an inner face thereof an annular bead that corresponds to the collar plate of the capsule when inserted in the receiving portion in use.

2. The water pipe according to claim 1, characterized by a wall of the receiving portion surrounding the sides of the capsule in order to provide the accurate fit between the capsule and the receiving portion.

3. The water pipe according to claim 2, characterized in that the wall of the receiving portion tapers conically in the direction of the interior of the heating chamber at an angle ($\alpha$) of 5°-10°.

4. The water pipe according to claim 1, characterized in that the diameter of the receiving portion between the front and rear of the receiving portion or the capsule, respectively, increases by a factor of approximately 1.1 to 1.25, preferably approx. 1.17.

5. The water pipe according to claim 1, characterized in that the receiving portion comprises on its inner side a front wall which has an opening and extends transverse to the longitudinal axis of the housing.

6. The water pipe according to claim 1, characterized in that the receiving portion has on its outer side a cover ring which extends transverse to the longitudinal axis of the housing.

7. The water pipe according to claim 6, characterized in that the cover ring serves as an end stop for a collar on the capsule side when the capsule is inserted into the heating chamber.

8. The water pipe according to claim 6, characterized in that the cover ring is connected to a collar provided on the outer side of the receiving portion or is formed integrally with said collar.

9. The water pipe according to claim 1, characterized in that the annular bead is equipped with latching means.

10. The water pipe according to claim 9, characterized in that the latching means are arranged adjustably in the radial direction.

11. The water pipe according to claim 1, characterized in that the plate comprises in its outer face a handle for actuation of the cover plate.

12. The water pipe according to claim 1, wherein the collar plate of the capsule is arranged opposite the annular bead so that the annular bead automatically presses the capsule into the receiving portion when the plate is closed.

13. The water pipe according to claim 1, wherein the receiving portion has a front wall arranged to define a clearance between the front wall and an opposing front wall of the capsule when the capsule is fully inserted in the receiving portion to provide the accurate fit.

14. A capsule holding a smoking medium for use in a water pipe, the capsule having a collar plate, an outlet and a conical wall extending between the collar plate and outlet, the collar and conical wall arranged to fit with a receiving portion of a water pipe in use so that the receiving portion provides a heating element for the capsule, wherein the collar plate has perforations and an annular groove.

15. The capsule according to claim 14, where the annular groove of the collar plate surrounds the perforations.

16. The capsule according to claim 14, wherein the annular groove is arranged to receive an annular bead on an inner face of a cover plate of the water pipe.

17. The capsule according to claim 14, wherein the capsule comprises a collar portion and the annular groove of the collar plate is between the perforations and the collar portion.

* * * * *